US010309742B1

(12) United States Patent
Viani

(10) Patent No.: US 10,309,742 B1
(45) Date of Patent: Jun. 4, 2019

(54) FIREARM ENHANCING TRIGGER CONNECTOR

(71) Applicant: Arthur J. Viani, Miami, FL (US)

(72) Inventor: Arthur J. Viani, Miami, FL (US)

( * ) Notice: Subject to any disclaimer, the term of this patent is extended or adjusted under 35 U.S.C. 154(b) by 0 days.

(21) Appl. No.: 16/054,164

(22) Filed: Aug. 3, 2018

Related U.S. Application Data

(63) Continuation-in-part of application No. 15/918,488, filed on Mar. 12, 2018, now Pat. No. 10,240,880.

(51) Int. Cl.
*F41A 19/32* (2006.01)
*F41A 19/12* (2006.01)

(52) U.S. Cl.
CPC ..... *F41A 19/32* (2013.01); *F41A 19/12* (2013.01)

(58) Field of Classification Search
CPC ..... F41A 19/10; F41A 19/12; F41A 19/32
USPC ..... 42/69.01, 69.03
See application file for complete search history.

(56) References Cited

U.S. PATENT DOCUMENTS 5,438,784 A * 8/1995 Lenkarski ..... F41A 17/36 42/70.02
5,822,903 A 10/1998 Davis
6,354,032 B1 * 3/2002 Viani ..... F41A 19/10 42/42.03
7,690,144 B2 * 4/2010 Fagundes de Campos ..... F41A 17/72 42/69.02
7,827,720 B1 * 11/2010 Erdem ..... F41A 17/72 42/70.01
8,510,980 B2 * 8/2013 Lee ..... F41A 19/10 42/69.01
8,935,872 B2 * 1/2015 Zukowski ..... F41A 17/56 42/70.02
9,062,925 B1 * 6/2015 Viani ..... F41A 19/06
9,404,700 B1 * 8/2016 Viani ..... F41A 19/06
9,410,758 B1 8/2016 Viani
9,927,200 B2 * 3/2018 Kuracina ..... F41A 19/30
2005/0034344 A1 * 2/2005 Viani ..... F41A 19/12 42/69.01
2006/0236581 A1 * 10/2006 Viani ..... F41A 19/30 42/69.01
2008/0263926 A1 * 10/2008 Bubits ..... F41A 17/72 42/69.02
2015/0330734 A1 * 11/2015 Kolev ..... F41A 3/12 42/69.01

* cited by examiner

*Primary Examiner* — Michelle Clement
(74) *Attorney, Agent, or Firm* — Albert Bordas, P.A.

(57) ABSTRACT

A firearm enhancing trigger connector having a torso with first and second edges. The torso has a guide lip mount extending from the torso beyond the first edge at a first predetermined angle. The guide lip mount has a guide lip positioned at a second predetermined angle approximately 65-80 degrees with respect to the second edge. The guide lip mount further has a control tab extending therefrom at a third predetermined angle from the first edge. The torso further has a first connector leg. The first connector leg has a reset tab. The torso also has a second connector leg and an elongated debris slot.

18 Claims, 5 Drawing Sheets

FIREARM ENHANCING TRIGGER CONNECTOR

OTHER RELATED APPLICATIONS

The present application is a continuation-in-part of pending U.S. patent application Ser. No. 15/918,488, filed on Mar. 12, 2018, which is hereby incorporated by reference.

BACKGROUND OF THE INVENTION

Field of the Invention

The present invention relates to firearm trigger connectors, and more particularly, to firearm enhancing trigger connectors.

Description of the Related Art

Applicant believes that one of the closest references corresponds to Applicant's own U.S. Pat. No. 9,062,925 issued to Arthur Viani on Jun. 23, 2015 for Enhanced trigger control connector. However, it differs from the present invention because Viani teaches a firearm enhanced trigger control connector. A torso has a guide angle positioned at a first predetermined angle. The guide angle contains a trigger bar of a firearm. The torso further has a first connector leg extending therefrom at a second predetermined angle. The first connector leg has a disconnector tab at a third predetermined angle. Extending from the first connector leg is a control tab. The torso further has a second connector leg that removably fits within a trigger housing of the firearm.

Applicant believes that another reference corresponds to Applicant's own U.S. Pat. No. 9,410,758 issued to Arthur Viani on Aug. 9, 2016 for Enhanced trigger control connector. However, it differs from the present invention because Viani teaches a firearm enhanced trigger control connector. A torso has a guide angle positioned at a first predetermined angle. The guide angle contains a trigger bar of a firearm. The torso further has a first connector leg extending therefrom at a second predetermined angle. The first connector leg has a disconnector tab at a third predetermined angle. Extending from the first connector leg is a control tab. The torso further has a second connector leg that removably fits within a trigger housing of the firearm.

Applicant believes that another reference corresponds to Applicant's own U.S. Pat. No. 9,404,700 issued to Arthur Viani on Aug. 2, 2016 for Enhanced trigger control connector. However, it differs from the present invention because Viani teaches a firearm enhanced trigger control connector. A torso has a guide angle positioned at a first predetermined angle. The guide angle contains a trigger bar of a firearm. The torso further has a first connector leg extending therefrom at a second predetermined angle. The first connector leg has a disconnector tab at a third predetermined angle. Extending from the first connector leg is a control tab. The torso further has a second connector leg that removably fits within a trigger housing of the firearm.

Applicant believes that another reference corresponds to U.S. Pat. No. 5,822,903 issued to Sr. James Jefrey Davis, on Oct. 20, 1998 for Externally adjustable slide trigger assemblies for handguns. However, it differs from the present invention because Davis teaches an externally adjustable slide trigger assembly, which is a drop-in replacement for existing conventional slide triggers. No drilling/tapping or other handgun modifications are required. The variable adjustment range provided allows the handgun owner to change trigger-pull characteristics from a stock trigger-pull weight to a low competition trigger-pull weight in the field. Trigger slack is completely eliminated at or near competition trigger-pull weights.

Applicant believes that another reference corresponds to U.S. Patent Application Publication No. 20060236581 published on Oct. 26, 2006 to Applicant's own Arthur Viani for Self-cleaning trigger connector system. However, it differs from the present invention because Viani teaches a self-cleaning trigger connector system resulting in increased reliability comprising a self-cleaning trigger connector and a trigger mechanism housing. The self-cleaning trigger connector is designed with specific contact points to prevent over-travel of the trigger bar when operating in cooperation with the trigger of the firearm. The self-cleaning trigger connector has a first at least one elongated through hole of a predetermined length that allows for a lighter trigger pull and defines a lubrication reservoir. The trigger mechanism housing comprises a second at least one elongated through hole. Debris that accumulates from the interaction between the trigger bar and the self-cleaning trigger connector passes through the first and second at least one elongated through holes. After passing through the first and second at least one elongated through holes, the debris then falls downwardly through a cavity adjacent to the firearm magazine well.

Other patents describing the closest subject matter provide for a number of more or less complicated features that fail to solve the problem in an efficient and economical way. None of these patents suggest the novel features of the present invention.

SUMMARY OF THE INVENTION

The present invention is a firearm enhancing trigger connector, comprising a torso having first and second edges. The torso comprises a guide lip mount extending from the torso beyond the first edge at a first predetermined angle. The guide lip mount comprises a guide lip positioned at a second predetermined angle approximately 65-80 degrees with respect to the second edge. The guide lip contains a trigger bar of a firearm. The guide lip mount further comprises a control tab extending therefrom at a third predetermined angle from the first edge. The torso further comprises a first connector leg extending from the torso towards the first edge at a fourth predetermined angle. The first connector leg has a reset tab at a fifth predetermined angle approximately 85-95 degrees with respect to the first connector leg. The torso further comprises a second connector leg that removably fits within a trigger housing of the firearm.

The trigger bar nearly contacts or contacts the guide lip when the firearm is in a rest position. The torso further comprises an elongated debris slot designed to minimize debris accumulation. The guide lip mount extends from the torso beyond the first edge a first predetermined distance, and the first connector leg extends from the torso beyond the first edge a second predetermined distance. The first predetermined distance is greater than the second predetermined distance. The first connector leg extends from the second edge. The reset tab is positioned over the guide lip. The guide lip is closer to the second connector leg than the reset tab. The first connector leg defines a sixth predetermined angle with respect to the guide lip, wherein the sixth predetermined angle is less than 90 degrees. The guide lip contains the trigger bar of the firearm when biased against the guide lip.

The trigger bar is biased against the torso when the firearm is in the rest position. The nearly contacts is a distance up to approximately 3 mm. As a trigger is pulled, the trigger bar slidably travels generally in a rearward and downward direction and the guide lip serves to guide an end of the trigger bar with no obstruction. The no obstruction is achieved with the second predetermined angle for the guide lip, saving a user from exerting a second force after exerting an initial force to pull the trigger.

After a point of firing, the trigger bar continues to travel generally in a rearward and downward direction until a cross edge contacts the control tab. A lobe cams the reset tab while cycling until completing an operating cycle with minimal obstruction. The minimal obstruction is achieved with the fifth predetermined angle of the reset tab, minimizing torsion forces while the cycling occurs.

The second connector leg is approximately opposite in direction from the guide lip and the reset tab. The first predetermined angle is approximately 130-140 degrees, and the third predetermined angle is approximately 40-50 degrees.

It is therefore one of the main objects of the present invention to provide a firearm enhancing trigger connector utilized to correct a trigger bar obstruction.

It is another object of the present invention to provide a firearm enhancing trigger connector for firearms to minimize trigger bar obstruction while it is traveling generally in a rearward and downward direction as the trigger is pulled, defining an undesired trigger pull effort.

It is another object of the present invention to provide a firearm enhancing trigger connector to prevent over manipulation of the trigger, which causes a reduction of accuracy while repetitive firing.

It is another object of the present invention to provide a firearm enhancing trigger connector to increase the speed of firing a firearm with a reduced trigger travel distance.

It is another object of the present invention to provide a firearm enhancing trigger connector utilized with semi-automatic pistols that have an enclosed striker assembly.

It is yet another object of this invention to provide such a firearm enhancing trigger connector that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1A:
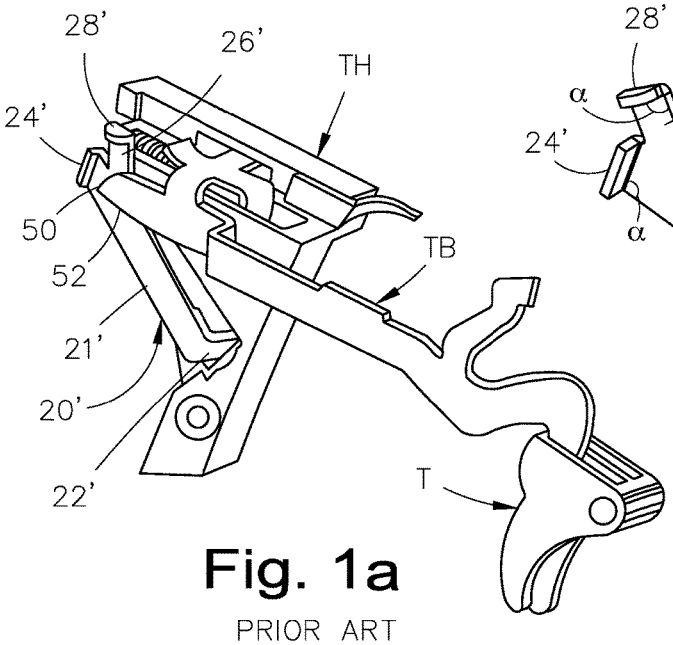
Fig. 1a PRIOR ART
FIG. 1*a* is an isometric view of the prior art trigger connector mounted onto a trigger bar and housing.

Referring now to the drawings, the present invention is generally referred to with numeral 10. It can be observed that it basically includes firearm enhancing trigger connector 220, bent at predetermined locations to permit its mechanical transactions to effectuate a trigger connector mechanism for minimizing trigger pull effort and torsion force effects.

Figure 1:
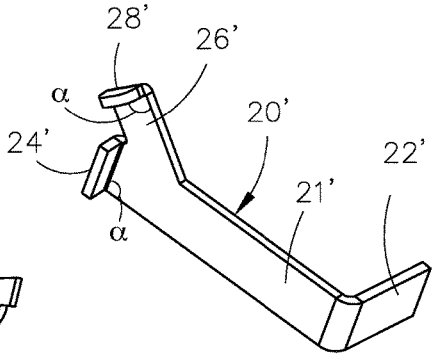
Fig. 1 PRIOR ART
FIG. 1 is an isometric view of a prior art trigger connector.

Seen in FIGS. 1 and 1*a* is prior art connector 20'. Torso 21' has lip 24'. Lip 24' serves to contain trigger bar TB when biased against it. Lip 24' is at angle α. Angle α is approximately 90 degrees. Connector leg 26' extends from torso 21' at a predetermined angle and has connector lip 28'. Connector lip 28' is at angle α from connector leg 26'. Angle α is approximately 90 degrees. Opposite in direction from lip 24' and connector lip 28' is connector leg 22'. FIG. 1*a* illustrates trigger bar TB secured onto trigger housing TH. Connector leg 22' removably fits within firearm F, seen in FIG. 2, to remain secured.

Figure 2:
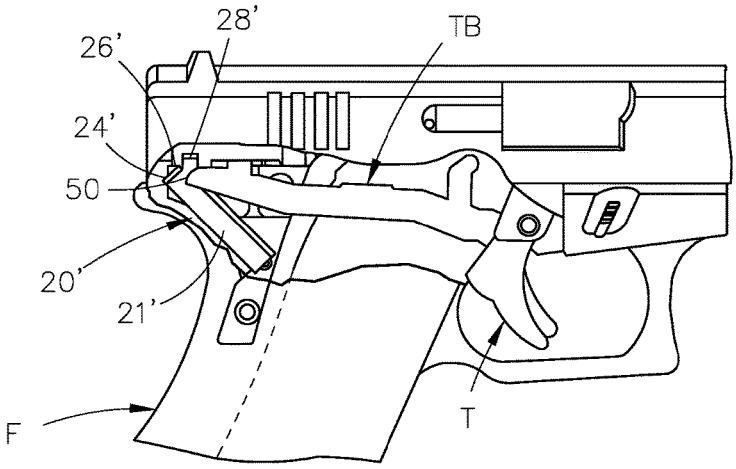
Fig. 2 PRIOR ART
FIG. 2 is an elevation view of the prior art trigger connector mounted onto the trigger bar and housing, before firing a firearm.

As seen in FIG. 2, prior art connector 20' works in conjunction with trigger bar TB. While firearm F, is in the rest position, trigger bar TB is biased against torso 21'. As trigger T is pulled, trigger bar TB slidably travels generally in a rearward and downward direction establishing undesired trigger pull excess travel.

Figure 2A:
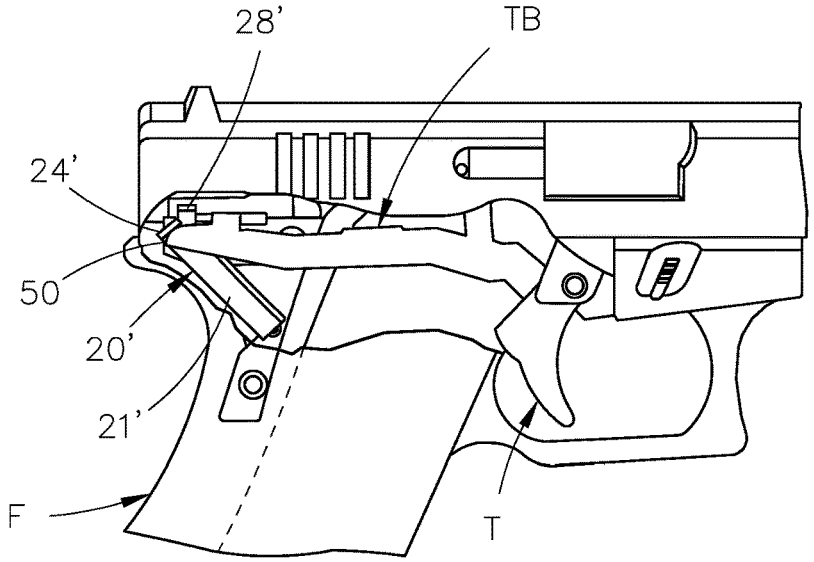
Fig. 2a PRIOR ART
FIG. 2*a* is an elevation view of the prior art trigger connector seen in FIG. 2, at the point of firing the firearm.

As seen in FIG. 2*a*, lip 24' serves to guide curved end 50. However, due to its position and angle A, lip 24' also is an obstruction. This obstruction causes a user to exert a second force to overcome the obstruction after exerting an initial force to pull trigger T. Thus, resulting in a reduction of accuracy and precision when firing. Trigger bar TB remains biased against torso 21' at the point of firing.

Figure 2B:
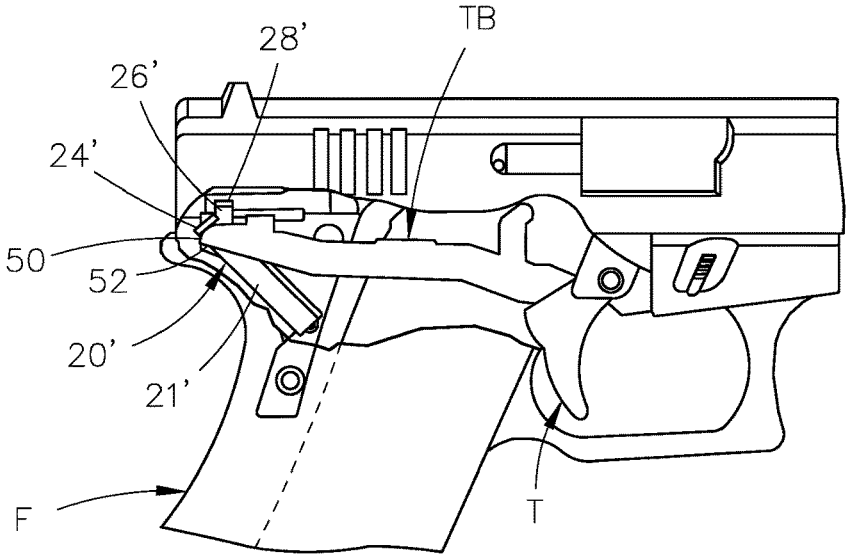
Fig. 2b PRIOR ART
FIG. 2*b* is an elevation view of the prior art trigger connector seen in FIG. 2*a*, after firing the firearm.

As seen in FIG. 2*b*, after the point of firing, trigger bar TB continuous to travel generally in a rearward and downward direction until a spring force, not shown, causes trigger bar TB to shift. Guided by connector lip 28', edge 52 of trigger bar TB slidably travels generally in a forward and upward direction until completing the operating cycle.

Figure 3:
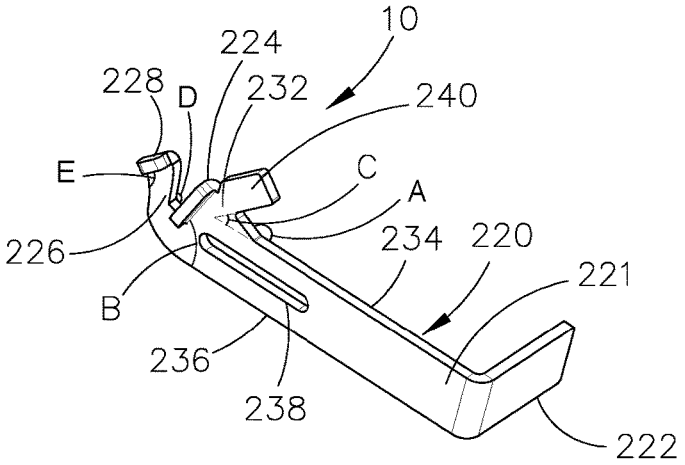
FIG. 3 is an isometric view of the present invention.
Figure 3A:
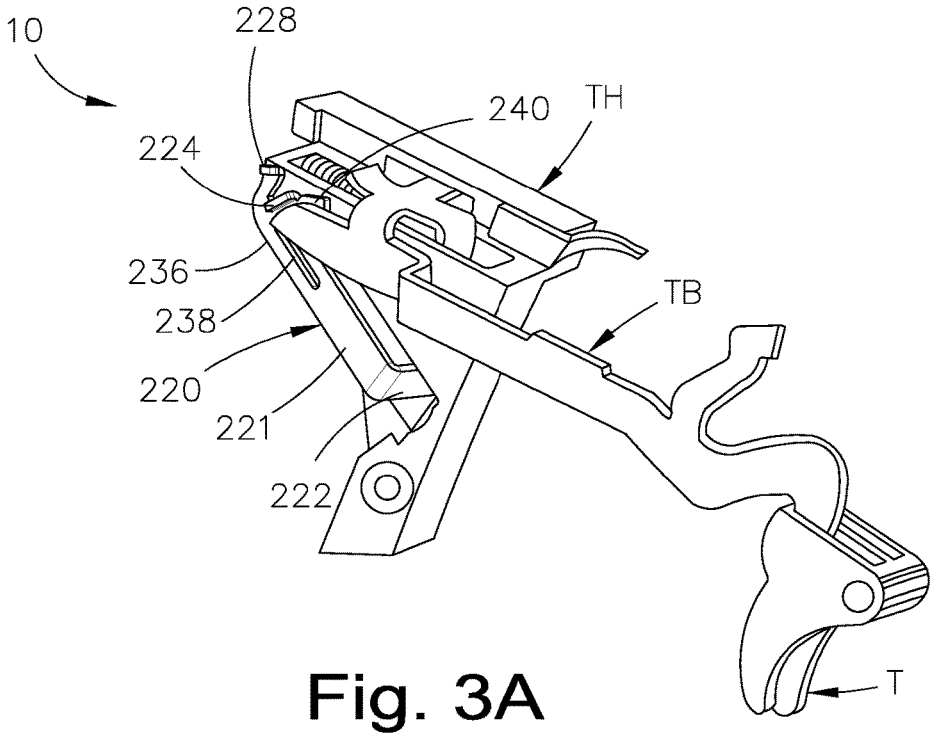
FIG. 3*a* is an isometric view of the present invention mounted onto a trigger bar and housing.

Seen in FIGS. 3 and 3*a* is the present invention, defined as firearm enhancing trigger connector 220. As seen in FIG. 3, firearm enhancing trigger connector 220 has torso 221 having first and second edges 234 and 236 respectively. Torso 221 has guide lip mount 232 extending beyond first edge 234 at a first predetermined angle A approximately 130-140 degrees. In a preferred embodiment, angle A is approximately 134 degrees. Guide lip mount 232 comprises guide lip 224 positioned at a second predetermined angle B approximately 65-80 degrees with respect to second edge 236. In a preferred embodiment, the second predetermined angle B is approximately 77 degrees. Guide lip 224 contains trigger bar TB of firearm F, seen in FIG. 4.

Guide lip mount 232 further comprises control tab 240 extending therefrom at a third predetermined angle C approximately 40-50 degrees from first edge 234. In a preferred embodiment, the third predetermined angle C is approximately 44 degrees. Torso 221 further comprises first connector leg 226 extending from torso 221 towards first edge 234 at a fourth predetermined angle. First connector leg 226 has reset tab 228 at a fifth predetermined angle E approximately 85-95 degrees with respect to first connector leg 226. In a preferred embodiment, fifth predetermined angle E is approximately 90 degrees. Approximately opposite in direction from guide lip 224 and reset tab 228 is connector leg 222. Torso 221 further comprises elongated debris slot 238. In a preferred embodiment, elongated debris slot 238 extends along of approximately a first half of torso 221. Elongated debris slot 238 is designed to minimize debris accumulation between trigger bar TB, seen in FIG. 3A, and firearm enhanced trigger connector 220.

Guide lip mount 232 extends from torso 221 beyond first edge 234 a first predetermined distance and first connector leg 226 extends from torso 221 beyond first edge 234 a second predetermined distance, wherein the first predetermined distance is greater than the second predetermined distance.

First connector leg 226 extends from second edge 236, whereby it defines a corner as it extends from second edge 236. Reset tab 228 is positioned over guide lip 224, and guide lip 224 is closer to second connector leg 222 than reset tab 228, whereby a distance from reset tab 228 to connector leg 222 is longer than a distance from guide lip 224 to connector leg 222. In addition, first connector leg 226 defines a sixth predetermined angle D with respect to guide lip 224, wherein the sixth predetermined angle D is less than 90 degrees. In a preferred embodiment sixth predetermined angle D is approximately 50-60 degrees, and more specifically approximately 56 degrees.

Figure 4:
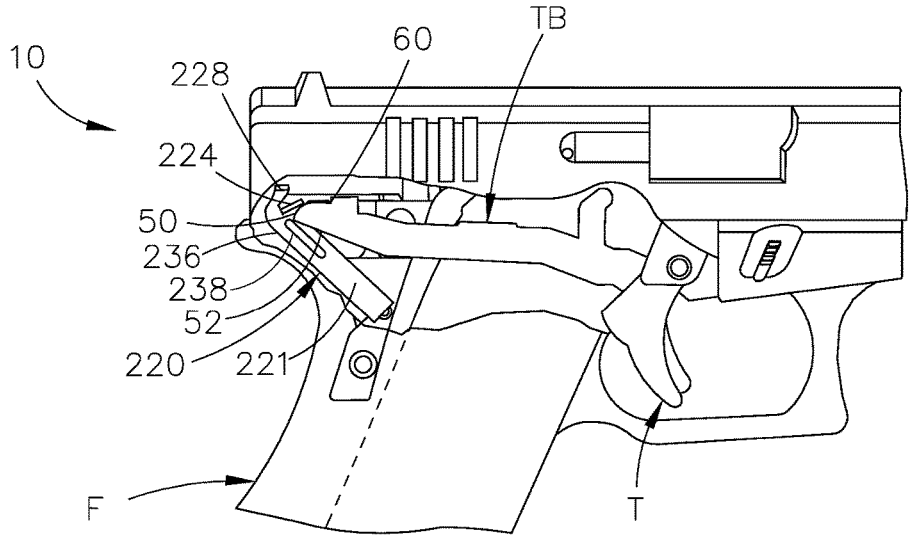
FIG. 4 is an elevation view of the present invention mounted onto the trigger bar and housing, before firing the firearm.

FIG. 3*a* illustrates trigger bar TB secured onto trigger housing TH. Second connector leg 222 removably fits within trigger housing TH of firearm F, as seen in FIG. 4, to remain secured. Guide lip 224 serves to contain trigger bar TB when biased against it. Trigger bar TB nearly contacts or contacts guide lip 224 when firearm F, seen in FIG. 4, is in a rest position.

Control tab 240 is designed as a specific contact to prevent over-travel of trigger bar TB when operating in cooperation with trigger T, and a spring force, not shown, causes trigger bar TB to shift.

The conventional placement of guide lip 224 and reset tab 228 is reversed from the prior art. Changing their placement creates the smoothest trigger pull possible. Thus, providing a mechanical advantage with present invention 10.

As seen in FIG. 4, firearm F is in the rest position. Once a user grasps firearm F, aims, and is ready to fire, the user exerts a force to overcome the force of trigger T. Trigger T is mechanically connected to trigger bar TB. In the rest position, trigger bar TB is biased against torso 221. It is noted that guide lip 224 is located at a predetermined positioned forward and elevated as compared to lip 24', seen in FIG. 1, and has a predetermined angle B, seen in FIG. 3, to contain trigger bar TB when biased against it.

More specifically, guide lip 224 is positioned at the predetermined angle B, seen in FIG. 3, whereby curved end 50 of trigger bar TB nearly contacts, or contacts, guide lip 224 when firearm F is in the rest position, as illustrated, to eliminate undesired trigger pull obstruction and to minimize trigger pull effort when trigger T is pulled. In a preferred embodiment, nearly contacts are defined as a distance up to approximately 3 mm.

As trigger T is pulled, trigger bar TB slidably travels generally in a rearward and downward direction and guide lip 224 serves to guide curved end 50 with no obstruction. The no obstruction is achieved with the predetermined angle B for guide lip 224, saving the user from exerting a second force after exerting an initial force to pull trigger T. Thus, resulting in improved accuracy and precision when firing. Trigger bar TB remains biased against torso 221 at the point of firing.

Figure 4A:
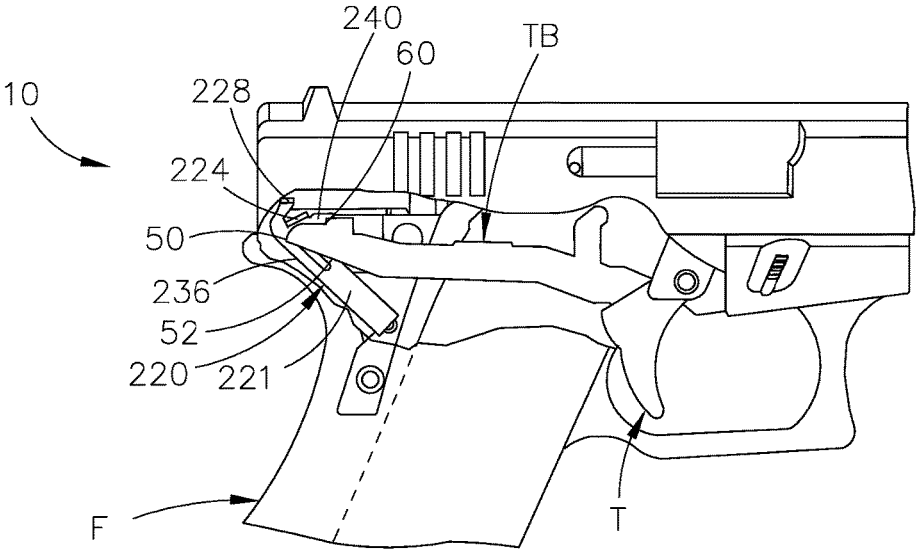
FIG. 4*a* is an elevation view of the present invention seen in FIG. 3, after firing the firearm.

As seen in FIG. 4*a*, after the point of firing, trigger bar TB continuous to travel generally in a rearward and downward direction. Cross edge 60 contacts control tab 240. Guided by reset tab 228, edge 52 of trigger bar TB then slidably travels generally in a forward and upward direction until completing the operating cycle. Control tab 240 establishes a shortened trigger travel distance. With a shortened trigger travel distance, less time is required for the user to discharge firearm F. As a result, the user benefits from each subsequent discharge with less time required for firearm F to cycle back into the rest position, as seen in FIG. 4.

Figure 5:
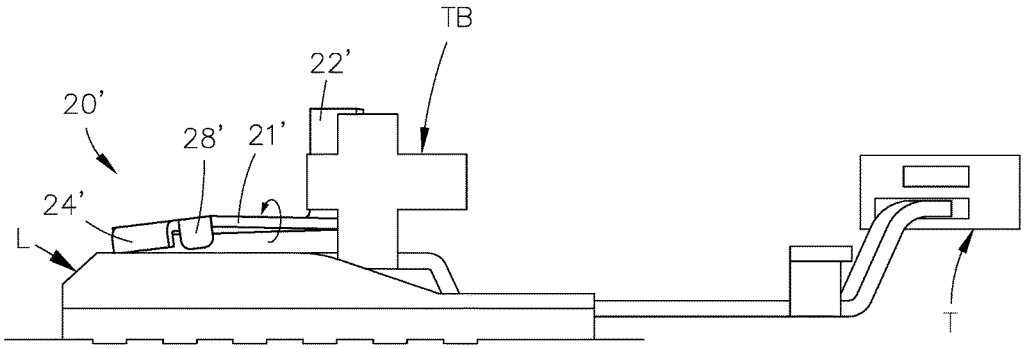
Fig. 5 PRIOR ART
FIG. 5 is a top view of the prior art trigger connector seen in FIG. 1, illustrating torsion forces while cycling.

As seen in FIG. 5, after the point of firing, trigger bar TB continues to travel generally in a rearward and downward direction. Connector lip 28' is cammed inwardly by lobe L until a spring force, not shown, causes trigger bar TB to shift. Edge 52, seen in FIG. 4A, of trigger bar TB slidably travels generally in a forward and upward direction. Lobe L defines a ramped surface that cams connector lip 28' while cycling until completing the operating cycle. However, due to its position, connector lip 28' also is an obstruction. This obstruction causes torsion forces upon prior art connector 20' while cycling. Thus, compromising the stability and durability of prior art connector 20'.

Figure 6:
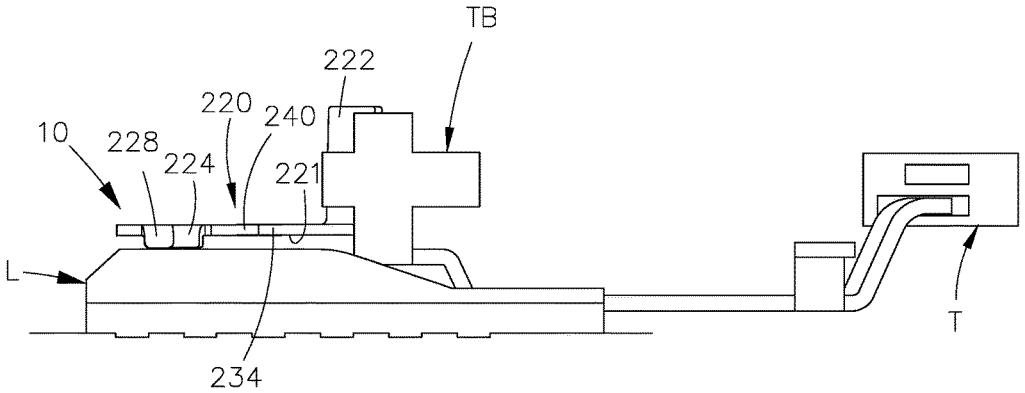
FIG. 6 is a top view of the present invention seen in FIG. 3, while cycling.

As seen in FIG. 6, after the point of firing, trigger bar TB continues to travel generally in a rearward and downward direction. Reset tab 228 is cammed inwardly by lobe L until a spring force, not shown, causes trigger bar TB to shift. Edge 52, seen in FIG. 4A, of trigger bar TB slidably travels generally in a forward and upward direction. Lobe L defines a ramped surface that cams reset tab 228 while cycling until completing the operating cycle with minimal obstruction. The minimal obstruction is achieved with the length and the fifth predetermined angle E of reset tab 228, minimizing torsion forces upon firearm enhancing trigger connector 220 while cycling. Thus, resulting in improved stability and durability.

Firearm enhancing trigger connector 220 is made out of a durable and light weight material as stainless steel, alloy metal, or other material having similar characteristics. In the preferred embodiment, firearm enhancing trigger connector 220 is manufactured as a single metallic piece and have a general consistent thickness throughout of approximately 0.10 mm to 2.00 mm, so as to cooperatively interact with the general trigger mechanism of semiautomatic firearms that have an enclosed striker assembly. Such a firearm may be "GLOCK", without limitation to this specific brand.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A firearm enhancing trigger connector, comprising a torso having first and second edges, said torso comprising a guide lip mount extending from said torso beyond said first edge at a first predetermined angle, said guide lip mount comprises a guide lip positioned at a second predetermined angle approximately 65-80 degrees with respect to said second edge, said guide lip containing a trigger bar of a firearm, said guide lip mount further comprises a control tab extending therefrom at a third predetermined angle from said first edge, said torso further comprising a first connector leg extending from said torso towards said first edge at a fourth predetermined angle, said first connector leg having a reset tab at a fifth predetermined angle approximately 85-95 degrees with respect to said first connector leg, said torso further comprising a second connector leg that removably fits within a trigger housing of said firearm, said trigger bar nearly contacts or contacts said guide lip when said firearm is in a rest position, said guide lip mount extends from said torso beyond said first edge a first predetermined distance, and said first connector leg extends from said torso beyond said first edge a second predetermined distance, and said first predetermined distance is greater than said second predetermined distance.

2. The firearm enhancing trigger connector set forth in claim 1, further characterized in that said torso further comprises an elongated debris slot designed to minimize debris accumulation.

3. The firearm enhancing trigger connector set forth in claim 1, further characterized in that said first connector leg extends from said second edge.

4. The firearm enhancing trigger connector set forth in claim 1, further characterized in that said reset tab is positioned over said guide lip.

5. The firearm enhancing trigger connector set forth in claim 1, further characterized in that said guide lip is closer to said second connector leg than said reset tab.

6. The firearm enhancing trigger connector set forth in claim 1, further characterized in that said first connector leg defines a sixth predetermined angle with respect to said guide lip, wherein said sixth predetermined angle is less than 90 degrees.

7. The firearm enhancing trigger connector set forth in claim 1, further characterized in that said guide lip contains said trigger bar of said firearm when biased against said guide lip.

8. The firearm enhancing trigger connector set forth in claim 1, further characterized in that said trigger bar is biased against said torso when said firearm is in said rest position.

9. The firearm enhancing trigger connector set forth in claim 1, further characterized in that said nearly contacts is a distance up to approximately 3 mm.

10. The firearm enhancing trigger connector set forth in claim 1, further characterized in that as a trigger is pulled, said trigger bar slidably travels generally in a rearward and downward direction and said guide lip serves to guide an end of said trigger bar with no obstruction.

11. The firearm enhancing trigger connector set forth in claim 10, further characterized in that said no obstruction is achieved with said second predetermined angle for said guide lip, saving a user from exerting a second force after exerting an initial force to pull said trigger.

12. The firearm enhancing trigger connector set forth in claim 1, further characterized in that after a point of firing, said trigger bar continues to travel generally in a rearward and downward direction until a cross edge contacts said control tab.

13. The firearm enhancing trigger connector set forth in claim 1, further characterized in that a lobe cams said reset tab while cycling until completing an operating cycle with minimal obstruction.

14. The firearm enhancing trigger connector set forth in claim 13, further characterized in that said minimal obstruction is achieved with said fifth predetermined angle of said reset tab, minimizing torsion forces while said cycling occurs.

15. The firearm enhancing trigger connector set forth in claim 1, further characterized in that said second connector leg is approximately opposite in direction from said guide lip.

16. The firearm enhancing trigger connector set forth in claim 1, further characterized in that said second connector leg is approximately opposite in direction from said reset tab.

17. The firearm enhancing trigger connector set forth in claim 1, further characterized in that said first predetermined angle is approximately 130-140 degrees.

18. The firearm enhancing trigger connector set forth in claim 1, further characterized in that said third predetermined angle is approximately 40-50 degrees.

* * * * *